US009775458B2

(12) United States Patent
Rivera

(10) Patent No.: US 9,775,458 B2
(45) Date of Patent: Oct. 3, 2017

(54) UNDER CABINET BREWING CARTRIDGE RACK

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 0 days.

(21) Appl. No.: 15/062,047

(22) Filed: Mar. 5, 2016

(65) Prior Publication Data

US 2017/0150838 A1 Jun. 1, 2017

Related U.S. Application Data

(60) Provisional application No. 62/261,681, filed on Dec. 1, 2015.

(51) Int. Cl.

| | |
|---|---|
| ***A47B 88/00*** | (2017.01) |
| ***A47B 46/00*** | (2006.01) |
| ***A47G 29/14*** | (2006.01) |
| ***A47B 81/00*** | (2006.01) |
| ***A47B 88/407*** | (2017.01) |

(52) U.S. Cl.

CPC ..... *A47G 29/14* (2013.01); *A47B 46/00* (2013.01); *A47B 81/00* (2013.01); *A47B 88/407* (2017.01)

(58) Field of Classification Search

CPC ... A47B 88/06; A47B 88/0407; A47B 46/005; A47B 88/407; A47B 46/00; A47G 29/14

See application file for complete search history.

(56) References Cited

U.S. PATENT DOCUMENTS

| | | | | | |
|---|---|---|---|---|---|
| 1,108,281 | A * | 8/1914 | Uffner | A47B 88/48 | 312/323 |
| 2,839,349 | A * | 6/1958 | Culver | A47B 88/06 | 312/323 |
| 3,211,290 | A * | 10/1965 | Strickling | B65B 21/18 | 209/522 |
| 3,442,378 | A * | 5/1969 | Wolfe | A47G 23/0641 | 206/459.5 |
| 3,846,005 | A * | 11/1974 | Harper | A47B 77/04 | 312/248 |
| 4,184,725 | A * | 1/1980 | Spangler | A47B 88/06 | 248/447 |
| 4,314,734 | A * | 2/1982 | Grunert | A47B 88/48 | 108/8 |
| 4,368,866 | A * | 1/1983 | Urban | B60R 11/02 | 224/929 |
| 4,441,771 | A * | 4/1984 | Roesler | A47B 88/18 | 312/322 |

(Continued)

*Primary Examiner* — Daniel J Troy
*Assistant Examiner* — Kimberley S Wright
(74) *Attorney, Agent, or Firm* — Averill & Green; Kenneth L. Green

(57) ABSTRACT

An under cabinet brewing cartridge holder includes a cartridge rack which both pivots at the rear and slide forward to clear a downward reaching lip along a front edge of the cabinet. The cartridge rack includes opposing lateral pins near the rack rear, which pins slide in horizontal slots in holder side walls. A sloped rear surface limits the downward pivot of the rack, and magnets retain the rack in the stored position. In another embodiment, a second under cabinet brewing cartridge holder includes unequal length arms attach a second rack to a slider engaging the horizontal slots. The second rack pivots down and away from the holder and slides forward and rearward.

13 Claims, 7 Drawing Sheets

(56) References Cited

U.S. PATENT DOCUMENTS 5,213,401 A * 5/1993 Hatcher ..... A47B 21/0314 312/208.1
5,244,272 A * 9/1993 Thompson ..... A47B 88/06 211/74
5,385,399 A * 1/1995 Weidner ..... A47B 63/00 312/190
5,957,558 A * 9/1999 Quade ..... A47B 88/06 312/246
6,299,267 B1 * 10/2001 Butters ..... A47B 77/10 108/143
6,348,864 B1 * 2/2002 Lin ..... G07C 9/00166 340/539.1
7,090,316 B2 * 8/2006 Model ..... A47B 88/48 312/323
7,140,703 B1 * 11/2006 Holdgate, III ..... A47B 88/18 312/323
7,350,647 B2 * 4/2008 Haller ..... A47B 57/04 211/75
D650,636 S * 12/2011 Roth ..... D7/600.1
8,136,897 B2 * 3/2012 Mascari ..... A47B 46/005 16/342
D661,950 S * 6/2012 Greenwood ..... D7/590
D677,992 S * 3/2013 Greenwood ..... D7/600.1
8,408,666 B2 * 4/2013 Armstrong ..... A47B 88/407 312/408
8,517,131 B2 * 8/2013 Kovach ..... H01M 2/1083 180/68.5
D709,718 S * 7/2014 Snyder ..... D6/682.4
8,851,306 B2 * 10/2014 Spurr ..... A47B 46/005 211/117
8,926,031 B2 * 1/2015 Belton ..... A47B 88/04 312/246
2004/0130247 A1 * 7/2004 Model ..... A47B 88/48 312/323
2010/0007253 A1 * 1/2010 Ryerson ..... A47B 88/18 312/247
2010/0084415 A1 * 4/2010 Mittet ..... A47B 88/0407 220/740
2012/0217858 A1 * 8/2012 Lai ..... A47B 17/00 312/334.5
2013/0020225 A1 * 1/2013 Zabinski ..... A47B 67/04 206/557
2013/0025510 A1 * 1/2013 White ..... E05B 37/20 109/51
2014/0021844 A1 * 1/2014 Belton ..... A47B 88/04 312/334.1
2015/0144035 A1 * 5/2015 Molteni ..... A47B 88/0407 108/26
2015/0176887 A1 * 6/2015 Castro Solis ..... F25D 25/025 312/405.1
2015/0351570 A1 * 12/2015 Lukjan ..... A47G 21/14 211/70.7
2016/0058173 A1 * 3/2016 Green ..... A47B 88/0407 108/26
2016/0088933 A1 * 3/2016 Rossignol ..... A47B 81/007 312/270.2

* cited by examiner

UNDER CABINET BREWING CARTRIDGE RACK

CROSS-REFERENCE TO RELATED APPLICATIONS

The present application claims the priority of U.S. Provisional Patent Application Ser. No. 62/261,681 filed Dec. 1, 2015, which application is incorporated in its entirety herein by reference.

BACKGROUND OF THE INVENTION

The present invention relates to brewing cartridge racks and in particular to a brewing cartridge rack for attaching under a cabinet having a downward reaching lip.

A large variety of brewing cartridges are available offering a wide selection of brewed drinks. Users often desire to locate a brewing cartridge holder close to a coffee maker for easy access to the cartridges. Because counter tops can easily become cluttered with various kitchen items, and the brewing cartridges themselves are not large, a brewing cartridge rack can be positioned under the base of a cabinet.

Known under cabinet brewing cartridge holders include a cartridge holder which slides forward. Unfortunately, many cabinets include a downward reaching lip which prevents the cartridge holder from sliding forward to access the cartridges as shown in FIG. 1. One solution has been to pivot the holder at the rear as shown in FIG. 2, however, the cabinet lip still limits access to the cartridges.

BRIEF SUMMARY OF THE INVENTION

The present invention addresses the above and other needs by providing an under cabinet brewing cartridge holder including a cartridge rack which both pivots at the rear and slide forward to clear a downward reaching lip along a front edge of the cabinet. The cartridge rack includes opposing lateral pins near the rack rear, which pins slide in horizontal slots in holder side walls. A sloped rear surface limits the downward pivot of the rack, and magnets retain the rack in the stored position. In another embodiment, a second under cabinet brewing cartridge holder includes unequal length arms attach a second rack to a slider engaging the horizontal slots. The second rack pivots down and away from the holder and slides forward and rearward.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
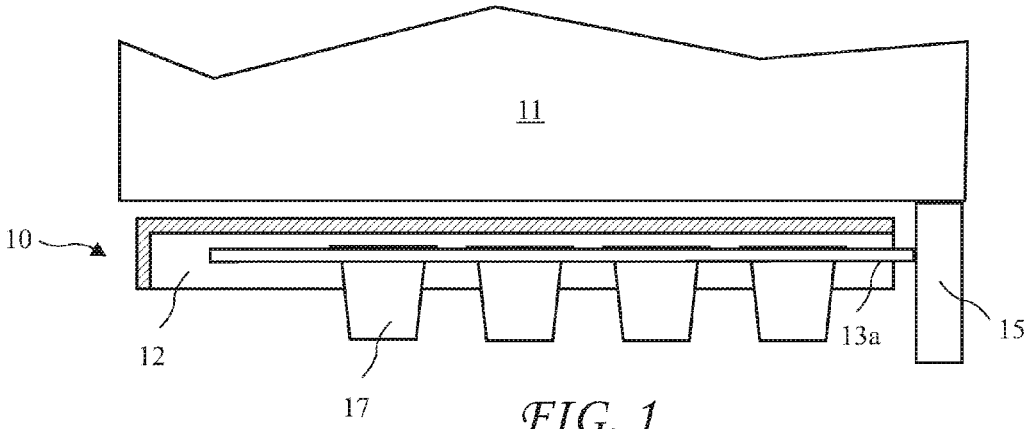
FIG. 1 (prior art)
FIG. 1 shows a prior art sliding, under cabinet, brewing cartridge holder.
Figure 2:
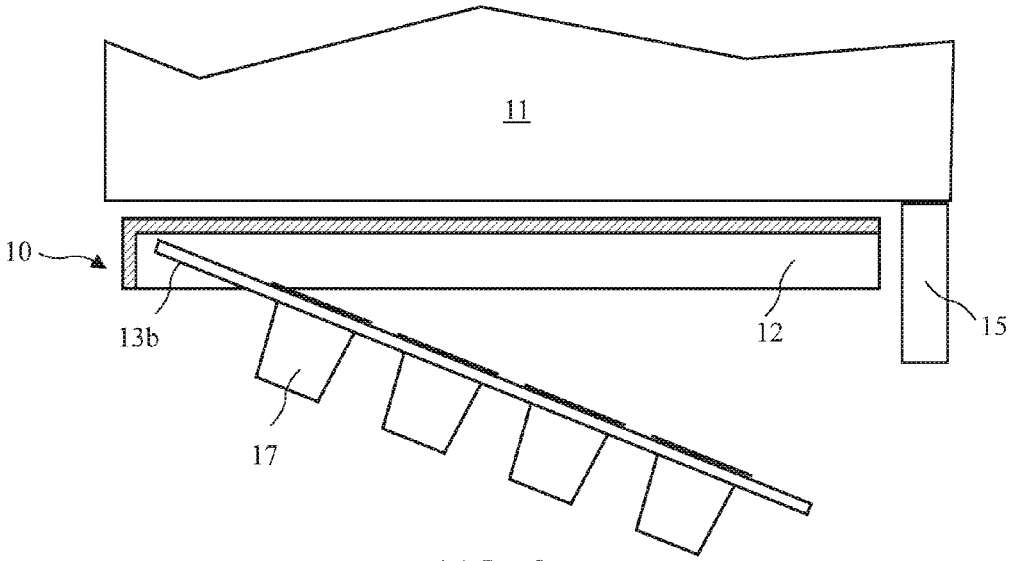
FIG. 2 (prior art)
FIG. 2 shows a prior art pivoting, under cabinet, brewing cartridge holder.

A prior art sliding, under cabinet, brewing cartridge holder 10 having a forward sliding rack 13*a* carried by a base 12 is shown in FIG. 1 and a prior art pivoting, under cabinet, brewing cartridge holder 10 having a pivoting rack 13*b* is shown in FIG. 2. Many cabinets 11 have a downward reaching lip 15, and both prior art holders fail to provide access to all of the cartridges 17 held in the racks 13*a* and 13*b*.

Figure 3:
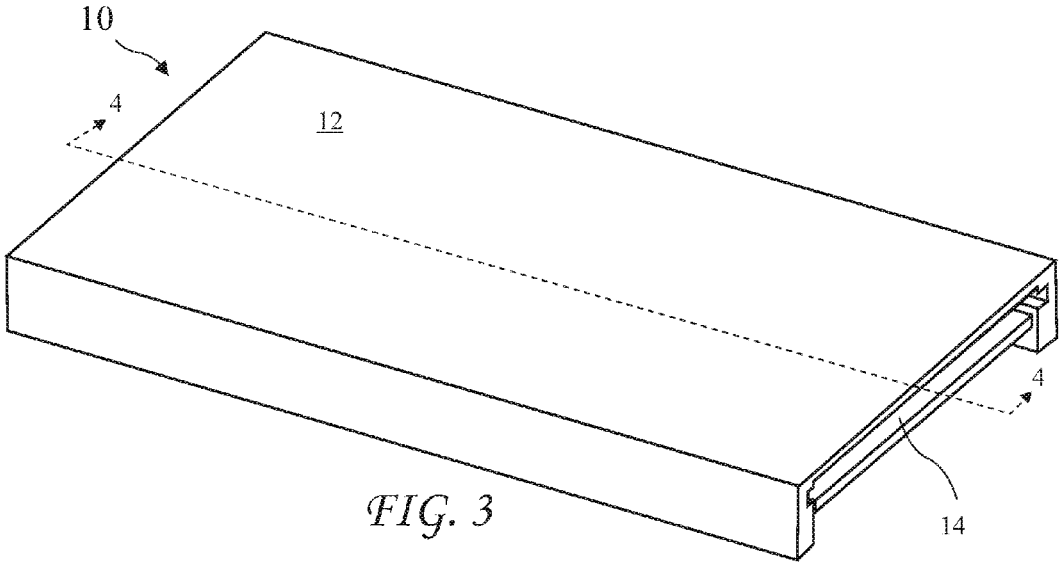
FIG. 3 shows a perspective view of a pivoting and sliding, under cabinet, brewing cartridge holder according to the present invention.
Figure 4:
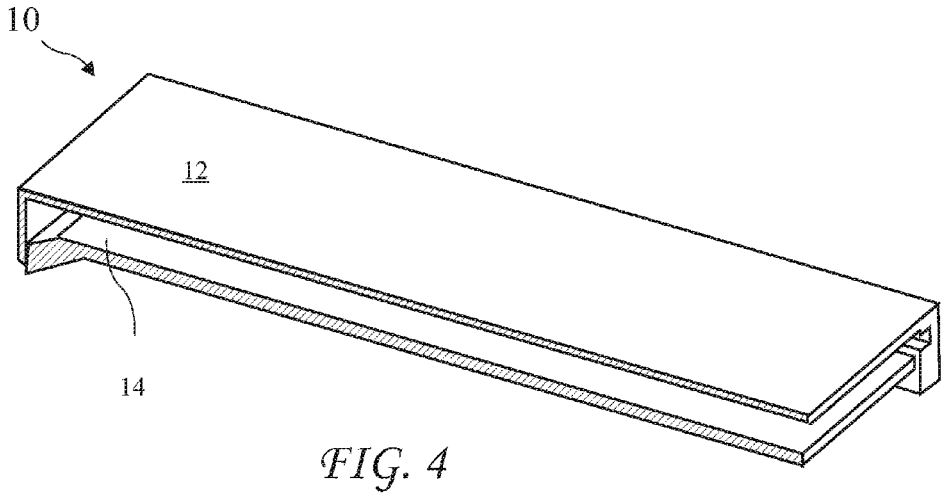
FIG. 4 shows a cross-sectional view of the pivoting and sliding, under cabinet, brewing cartridge holder according to the present invention taken along line 4-4 of FIG. 3.

A perspective view of a pivoting and sliding, under cabinet, brewing cartridge holder 10 according to the present invention is shown in FIG. 3 and a cross-sectional view of the pivoting and sliding, under cabinet, brewing cartridge holder 10 taken along line 4-4 of FIG. 3 is shown in FIG. 4. The brewing cartridge holder 10 includes a base 12 fixed to the bottom of the cabinet 11 and a cartridge holder comprising a pivoting and sliding cartridge rack 14.

Figure 5:
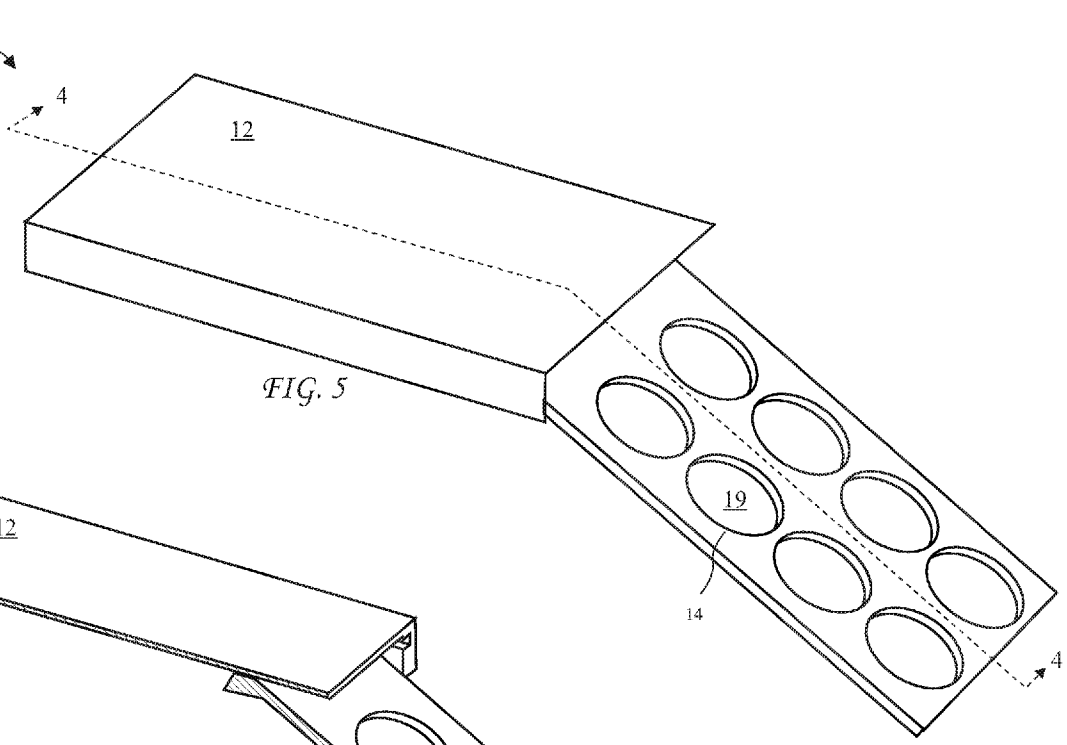
FIG. 5 shows a perspective view of the pivoting and sliding, under cabinet, brewing cartridge holder with a cartridge rack pivoted down and extended according to the present invention.
Figure 6:
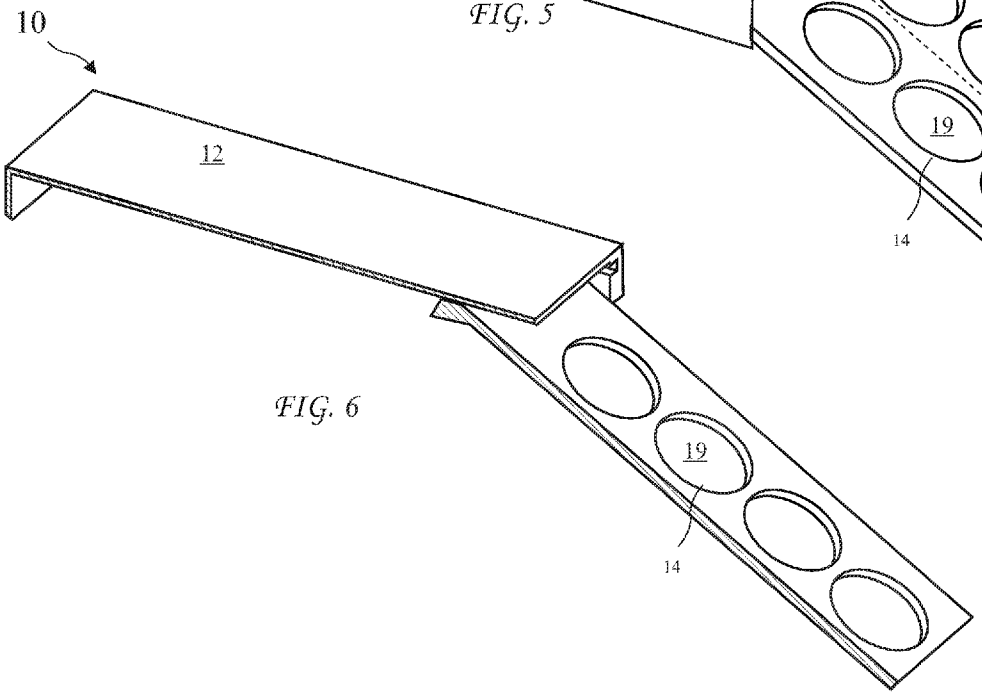
FIG. 6 shows a cross-sectional view of the pivoting and sliding, under cabinet, brewing cartridge holder with the cartridge rack pivoted down and extended according to the present invention taken along line 6-6 of FIG. 5.

A perspective view of the brewing cartridge holder 10 with the cartridge rack 14 pivoted down and extended is shown in FIG. 5 and a cross-sectional view of the brewing cartridge holder 10 with the cartridge rack 14 pivoted down and extended, taken along line 6-6 of FIG. 5, is shown in FIG. 6. Both pivoting and sliding the cartridge rack 14 provides good access to brewing cartridges 17 stored in the brewing cartridge holder 10. The cartridge rack 14 includes holes 19 sized to retain brewing cartridges sold under the name K-CUP.

Figures 7, 8, 9, 10:
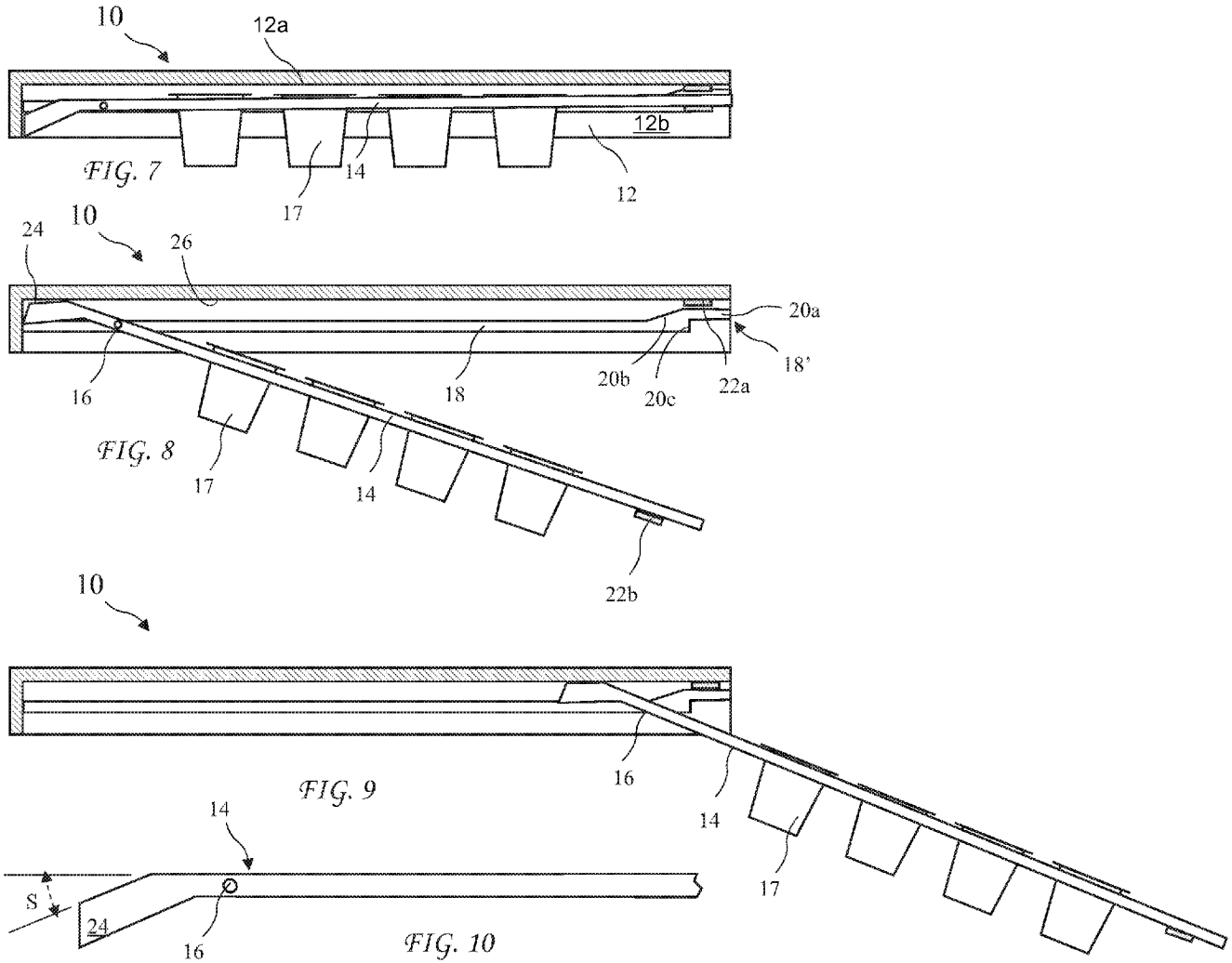
FIG. 7 shows a cross-sectional side view of the pivoting and sliding, under cabinet, brewing cartridge holder with the cartridge rack stored, according to the present invention.
FIG. 8 shows a cross-sectional side view of the pivoting and sliding, under cabinet, brewing cartridge holder with the cartridge rack pivoted down, according to the present invention.
FIG. 9 shows a cross-sectional side view of the pivoting and sliding, under cabinet, brewing cartridge holder with the cartridge rack pivoted down and moved forward, according to the present invention.
FIG. 10 shows a side view of a rear portion of a cartridge rack according to the present invention.

A cross-sectional side view of the brewing cartridge holder 10 with the cartridge rack 14 stored horizontally in a rear position, is shown in FIG. 7, a cross-sectional side view of the brewing cartridge holder 10 with the cartridge rack 14 pivoted down, is shown in FIG. 8, and a cross-sectional side view of the brewing cartridge holder 10 with the cartridge rack 14 pivoted down to a tilted position and moved forward to a forward position, is shown in FIG. 9. The cartridge rack 14 includes laterally opposed pins 16 engaging slots 18 in vertical side walls of the base 12. A first magnet 20*a* is attached inside a forward end of the base 12, and a second magnet 22*b* is attached to the bottom of the forward end of the cartridge rack 14. When the cartridge rack 14 is slid fully to the rear and lifted, the magnets 22*a* and 22*b* retain the cartridge rack 14 in a closed position.

A forward end of the 18' of the slot 18 includes a raised mouth 20*a*, ceiling ramp 20*b*, and a forward stop 20*c*. The cartridge rack 14 is insertable into the base 12 by sliding the pins 16 into the mouths 20*a*, to the rear, and slightly down. When the cartridge rack 14 is drawn forward, the forward motion is stopped when the pins 16 contact the forward stops 20*c*. The rear of the cartridge rack 14 may be raised to allow the pins 16 to clear the forward stops 20*c* to remove the cartridge rack 14 from the base 12.

A side view of a rear portion of the cartridge rack 14 is shown in FIG. 10. When the magnets 22*a* and 22*b* are separated and the front of the cartridge rack 14 is lowered, a stop angle S is provided by a sloped portion 24 at the extreme rear of the cartridge rack 14 rises against a ceiling (or bottom face) 26 of the base 12, preventing further tilting of the cartridge rack 14 beyond the angle S.

Figure 10A:
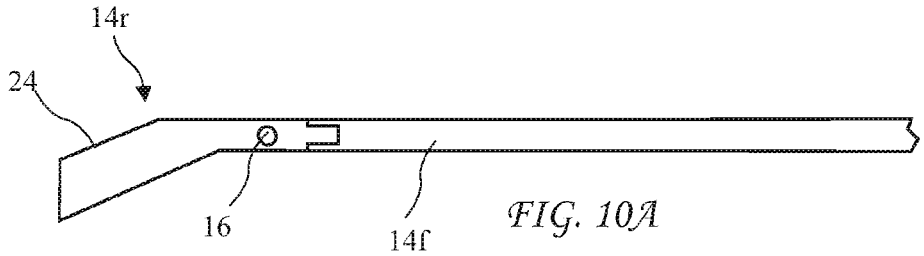
FIG. 10A shows a side view of a rear portion of a two piece cartridge rack, according to the present invention.

A side view of a rear portion of a two piece cartridge rack 14*a* is shown in FIG. 10A. The cartridge rack 14*a* includes a metal tray front portion 14*f* attached to a plastic rear portion 14*r*.

Figure 10B:
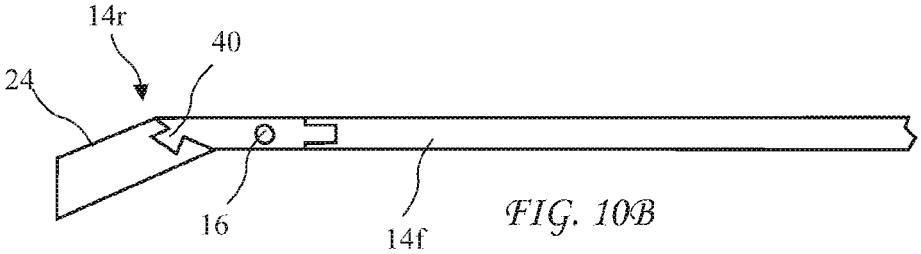
FIG. 10B shows a side view of a rear portion of a three piece cartridge rack having a replaceable stop, according to the present invention.

A side view of a rear portion of a three piece cartridge rack having a replaceable stop 24 is shown in FIG. 10B. The replaceable stop 24 is shown attached by a dovetail 40, but may be attached by any appropriate engagement. The replaceable stop 24 is preferably easy to remove and replace, allowing easy adjustment of the stop angle S.

Figure 10C:
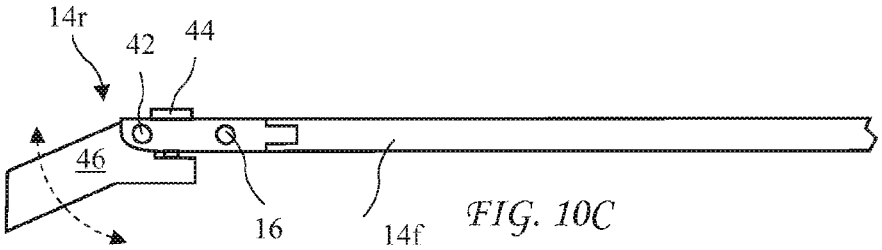
FIG. 10C shows a side view of a rear portion of a three piece cartridge rack having an adjustable stop, according to the present invention.

FIG. 10C shows a side view of a rear portion of a three piece cartridge rack having an adjustable stop 46. A screw 44 allows an adjustable stop angle S.

Figure 10D:
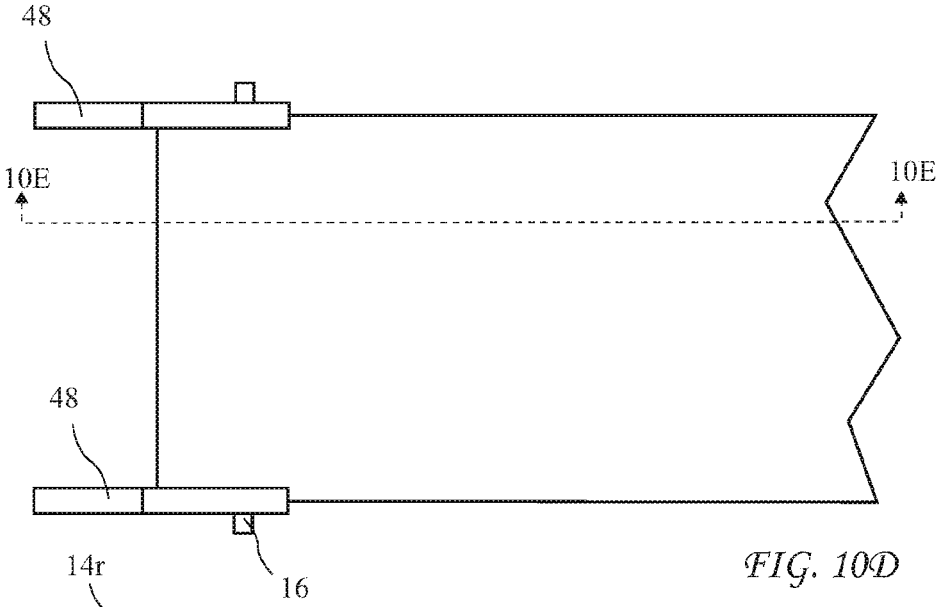
FIG. 10D shows a top view of a rear portion of a three piece cartridge rack having attachable left and right stops, according to the present invention.
Figure 10E:
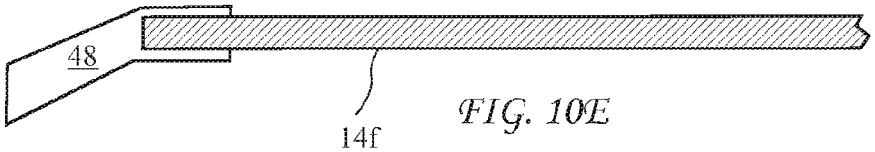
FIG. 10E shows a cross-sectional view of a rear portion of a three piece cartridge rack having attachable left and right stops taken along line 4E=4E of FIG. 4D, according to the present invention.

FIG. 10D shows a top view of a rear portion of a three piece cartridge rack and a cross-sectional view of a rear portion of a three piece cartridge rack taken along line 4E-4E of FIG. 4D is shown in FIG. 10E. The three piece cartridge rack includes attachable and replaceable left and right stops 48. The pins 16 may be part of the left and right stops 48 or part of the front portion 14*f*.

Figure 11A:
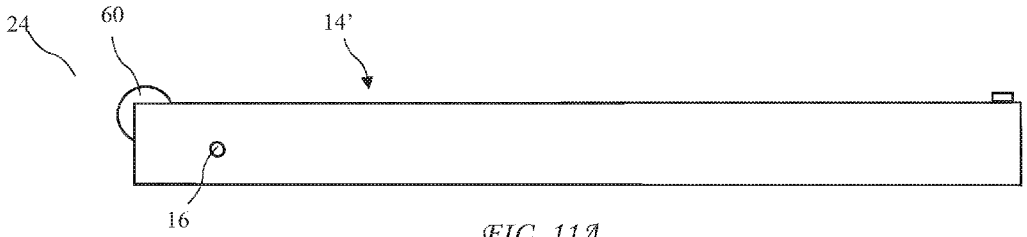
FIG. 11A shows a side view of a carriage drawer having rollers according to the present invention.
Figure 11B:
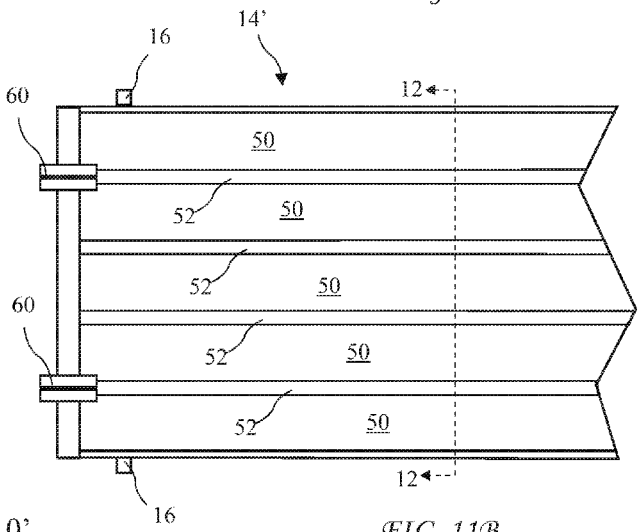
FIG. 11B shows a top view of the carriage drawer having rollers according to the present invention.
Figure 12:
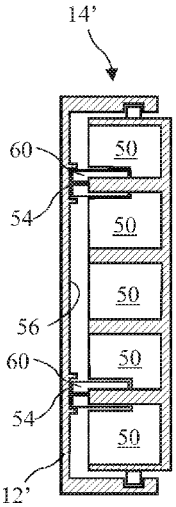
FIG. 12 shows a cross-sectional view of the carriage drawer having rollers and in a base, according to the present invention taken along line 12-12 of FIG. 11B.

A side view of a cartridge holder comprising a carriage drawer 14' having rollers 60 is shown in FIG. 11A, a top view of the carriage drawer 14' having rollers 60 is shown in FIG. 11B, and a cross-sectional view of the carriage drawer 14' having rollers 60, in a base 12', taken along line 12-12 of FIG. 11B, is shown in FIG. 12. The carriage drawer 14' includes the pins 16 for sliding in the slots 18, but the rollers 60 replace the stop 24 providing a smooth manipulation of the carriage drawer 14'. The carriage drawer 14' preferably includes channels 50 separated by walls 52 for orderly storing brewing cartridges, and the channels are more preferably sized to accept brewing cartridges sold under the name K-CUP. The base 12' includes tracks 54 on a ceiling 56 to guide the rollers 60. The tracks may be formed by a recess in the ceiling 56, or by pairs of ridges extending form the ceiling 56, or may be a single ridge or recess matched to a roller recess or roller ridge on the roller 60.

Figure 13A:
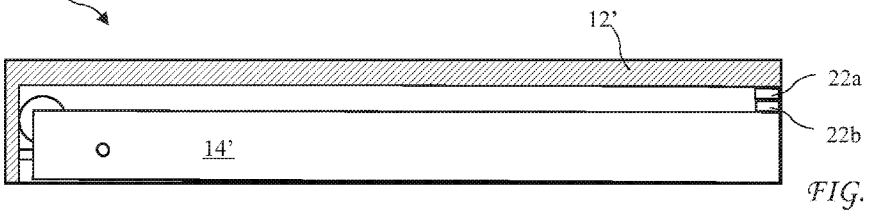
FIG. 13A shows a side view of the carriage drawer having rollers stored in a base according to the present invention.
Figure 13B:
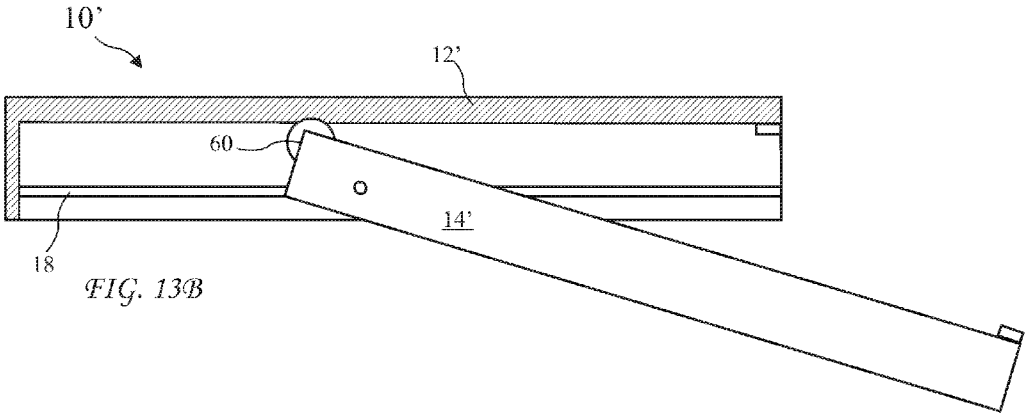
FIG. 13B shows a side view of the carriage drawer having rollers stored in the base with the cartridge drawer pivoted down and moved forward, according to the present invention.

A side view of the carriage drawer 14' stored in the base 12' is shown in FIG. 13A and a side view of the carriage drawer 14' stored in the base 12' with the cartridge drawer 14' pivoted down and moved forward, is shown in FIG. 13B. The cartridge drawer 14' is preferably held in the stored position by magnets 22*a* and 22*b*, but those skilled in the art will recognize that the cartridge drawer 14' may be held by velcro, mechanical snaps, a tongue and groove, or other mechanical apparatus, and a brewing cartridge holder 10' held in the stored position in any manner is intended to come within the scope of the present invention. The geometry of the roller 60 and pin 16 may be selected to vary the tilt of the cartridge drawer 14' and any such selection is intended to come within the scope of the present invention.

Figure 14:
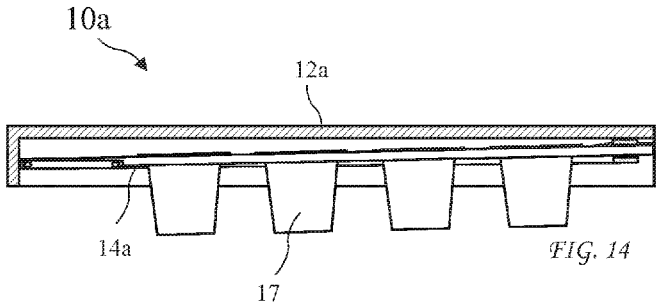
FIG. 14 shows a cross-sectional side view of a second pivoting and sliding, under cabinet, brewing cartridge holder with the cartridge rack stored, according to the present invention.
Figure 15:
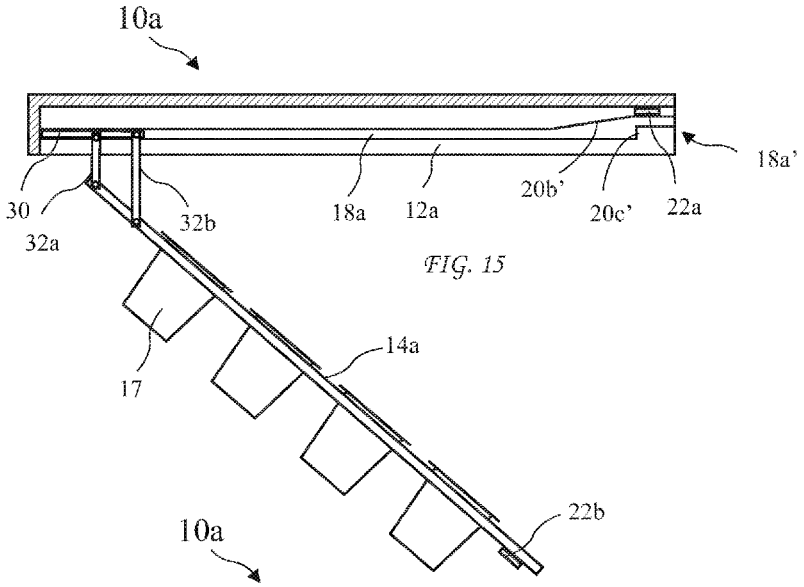
FIG. 15 shows a cross-sectional side view of the second pivoting and sliding, under cabinet, brewing cartridge holder with the cartridge rack pivoted down, according to the present invention.
Figure 16:
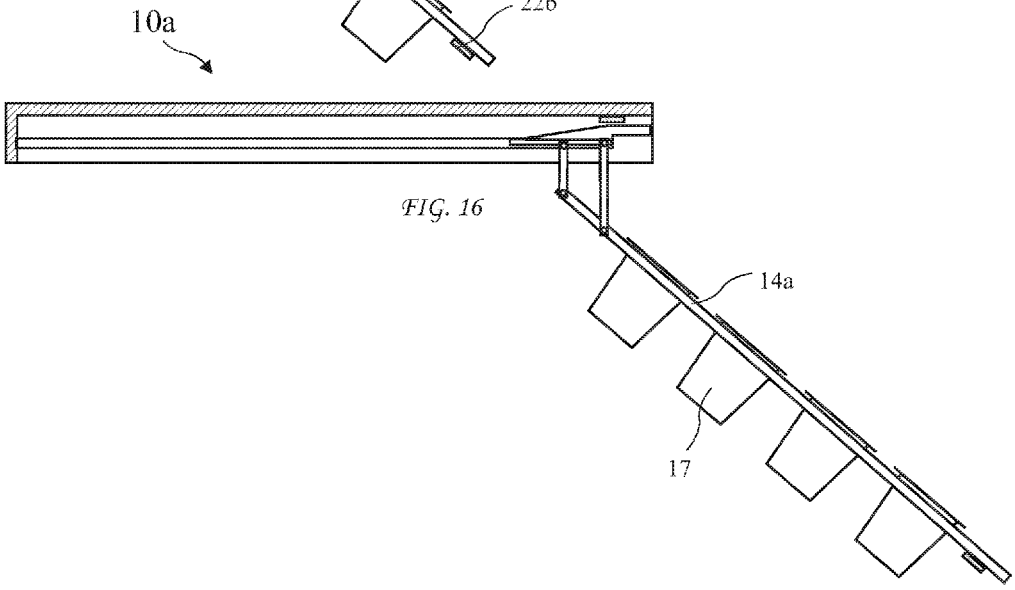
FIG. 16 shows a cross-sectional side view of the second pivoting and sliding, under cabinet, brewing cartridge holder with the cartridge rack pivoted down and moved forward, according to the present invention.

A cross-sectional side view of a second pivoting and sliding, under cabinet, brewing cartridge holder 10*a* with a cartridge rack 14*a* stored, is shown in FIG. 14, a cross-sectional side view of the brewing cartridge holder 10*a* with the cartridge rack 14*a* pivoted down, is shown in FIG. 15, and a cross-sectional side view of the brewing cartridge holder 10*a* with the cartridge rack pivoted down and moved forward, is shown in FIG. 16. The cartridge rack 14*a* is attached to a slider 10 by unequal length arms 32*a* and 32*b*. The slider 30 slides forwards and rearwards in slots 18*a*. The forward end 18*a*' of the slot 18*a* includes a longer ceiling ramp 20*b*' allowing insertion of the slider 30 into the base 12*a*. Forward motion of the slider 30 is halted by forward stops 20*c*'.

When the cartridge rack 14*a* is stored, the magnets 22*a* and 22*b* retain the cartridge rack 14*a* in the stored position. When the front of the cartridge rack 14*a* is pulled down, the unequal length arms 32*a* and 32*b* cause the cartridge rack 14*a* to tilt down at the forward end. The slider 30 may then slide forward in the slots 18*a*.

Left and right vertical walls are mirror images of each other, and the cartridge rack 14*a* is laterally symmetric. The arms 32*a* and 32*b* are offset to avoid interference and are on both sides of the cartridge rack 14*a*. The holders 10, 10', and 10*a* are preferably sized to hold brewing cartridges sold under the name K-CUP described in U.S. Pat. No. 5,325,765. The '765 patent is herein incorporated by reference in its entirety.

While the invention herein disclosed has been described by means of specific embodiments and applications thereof, numerous modifications and variations could be made thereto by those skilled in the art without departing from the scope of the invention set forth in the claims.

I claim:

1. A brewing cartridge holder, comprising:

a generally horizontal base attachable to a bottom surface of a cabinet, the base comprising:

opposing parallel vertical side walls on each side of the base, the walls having a top edge;

a generally horizontal ceiling at the top edges of the vertical side walls, the ceiling having a generally horizontal bottom face; and opposing generally horizontal inner slots in inside surfaces of the vertical side walls reaching from rear to front of the vertical side walls;

a cartridge rack comprising;

a body for retaining brewing cartridges;

opposing lateral pins near a rear end of the cartridge rack residing simultaneously in both horizontal inner slots of the base, the opposing lateral pins slidable in the horizontal inner slots to translate the cartridge rack forward and rearward between a rear position and a forward position, and the cartridge rack is tiltable to a tilted position about the lateral pins in all positions of the cartridge rack in the base between a position proximal to the rear position and the forward position; and a stop at the rear of the cartridge rack;

the cartridge rack and base cooperating to releasably retain the cartridge rack in a rearward and generally horizontal position in the base; and wherein cooperation of the stop resting against the bottom face of the ceiling of the base, and the opposing lateral pins in the inner slots, limits the downward tilt of a forward end of the cartridge rack in the tilted position.

2. The holder of claim 1, wherein the cartridge rack includes holes to retain brewing cartridges.

3. The holder of claim 1, wherein the cartridge rack includes channels to retain brewing cartridges.

4. The holder of claim 1, wherein the base includes forward stops in the inner slots near the forward end of the base limiting forward motion of the cartridge rack in the base.

5. The holder of claim 1, wherein the cartridge rack is retained generally horizontally in the base by cooperating features at a forward edge to releasably retain the cartridge rack in a stored position.

6. The holder of claim 5, wherein the cooperating features are magnets.

7. The holder of claim 1, wherein the base has an open front.

8. The holder of claim 7 wherein the cartridge rack is forwardly and rearwardly translatable in the base at any or no tilt of the cartridge rack.

9. The holder of claim 1, wherein cooperation of the stop resting against the bottom face of the base, and the opposing lateral pins in the inner slots, limit the tilt of the cartridge rack in a tilted position less than vertical.

10. The holder of claim 1, wherein the stop comprises a sloped surface sloping downward and rearward at the rear of the cartridge rack and facing upward and rearward towards the bottom face of the base.

11. The holder of claim 10, wherein cooperation of the sloped surface resting against the bottom face of the base, and the opposing lateral pins in the inner slots, limit the tilt of the cartridge rack in a tilted position less than vertical.

12. A brewing cartridge holder, comprising:

a generally horizontal base attachable to a bottom surface of a cabinet, the base comprising:

opposing parallel vertical side walls on each side of the base, the walls having a top edge;

a generally horizontal ceiling attached to the vertical side walls at the top edges of the vertical side walls, the ceiling having a generally horizontal bottom face;

opposing generally horizontal inner slots in inside surfaces of the vertical side walls reaching from rear to front of the vertical side walls; and an open front;

a cartridge rack comprising;

a body for retaining brewing cartridges;

opposing lateral pins near a rear end of the cartridge rack residing simultaneously in both horizontal inner slots of the base, the opposing lateral pins slidable in the horizontal inner slots to translate the cartridge rack forward and rearward between a rear position and a forward position, and the cartridge rack tiltable to a tilted position about the lateral pins in all positions of the cartridge rack in the base between a position proximal to the rear position and the forward position; and a stop at the rear of the cartridge rack;

the cartridge rack retainable in a rearward generally horizontal position in the base by cooperating magnets at forward ends of the base and the cartridge rack; and wherein cooperation of the stop resting against the bottom face of the ceiling of the base, and the opposing lateral pins in the inner slots, limits the downward tilt of a forward end of the cartridge rack in the tilted position.

13. A brewing cartridge holder, comprising:

a generally horizontal base attachable to a bottom surface of a cabinet, the base comprising:

opposing parallel vertical side walls on each side of the base, the walls having a top edge;

a generally horizontal ceiling joining the vertical sidewalls at the top edges of the vertical side walls, the ceiling having a generally horizontal bottom face;

opposing generally horizontal inner slots in inside surfaces of the vertical side walls reaching between rear and front of the vertical side walls; and an open front;

a cartridge rack comprising;

a body for retaining brewing cartridges;

opposing lateral pins near a rear end of the cartridge rack residing simultaneously in both horizontal inner slots of the base, the opposing lateral pins slidable in the horizontal inner slots to translate the cartridge rack forward and rearward between a rear position and a forward position, and the cartridge rack at any tilt of the cartridge rack and tiltable from a generally horizontal position to a tilted position about the lateral pins in all positions of the cartridge rack in the base between a position proximal to the rear position and the forward position; and a stop at the rear of the cartridge rack comprises a sloped surface sloping downward and rearward at the rear of the cartridge rack and facing upward and rearward towards the bottom face of the base;

wherein:

the cartridge rack is retainable in a rearward generally horizontal position in the base by cooperating magnets at forward ends of the base and the cartridge rack; and cooperation of the stop resting against the bottom face of the ceiling of the base, and the opposing lateral pins in the inner slots, limits the downward tilt of a forward end of the cartridge rack to less than 90 degrees in the tilted position.

* * * * *